US011753220B2

(12) United States Patent
Piao et al.

(10) Patent No.: US 11,753,220 B2
(45) Date of Patent: Sep. 12, 2023

(54) CONTAINER CAP AND A PACKAGE HAVING THE CAP

(71) Applicant: Conopco, Inc., Englewood Cliffs, NJ (US)

(72) Inventors: ZaiXian Piao, Shanghai (CN); Patricia Nogueira Martins Amando De Barros, Englewood Cliffs, NJ (US); Silvia Olla, Singapore (SG); Muriel Schildknecht, Singapore (SG)

(73) Assignee: Conopco, Inc., Englewood Cliffs, NJ (US)

( * ) Notice: Subject to any disclaimer, the term of this patent is extended or adjusted under 35 U.S.C. 154(b) by 292 days.

(21) Appl. No.: 16/478,618

(22) PCT Filed: Jan. 18, 2018

(86) PCT No.: PCT/CN2018/073215
§ 371 (c)(1),
(2) Date: Jul. 17, 2019

(87) PCT Pub. No.: WO2018/133817
PCT Pub. Date: Jul. 26, 2018

(65) Prior Publication Data

US 2019/0375562 A1 Dec. 12, 2019

(30) Foreign Application Priority Data

Jan. 19, 2017 (CN) ..... 201720059034.7

(51) Int. Cl.
*B65D 51/28* (2006.01)
*B65D 41/04* (2006.01)
(Continued)

(52) U.S. Cl.
CPC ..... *B65D 51/28* (2013.01); *A45D 40/00* (2013.01); *A45D 40/18* (2013.01); *A45D 40/24* (2013.01);
(Continued)

(58) Field of Classification Search
CPC ..... B65D 51/28; B65D 2251/0028; B65D 85/72; A45D 40/24; A45D 40/00;
(Continued)

(56) References Cited

U.S. PATENT DOCUMENTS 933,444 A 9/1909 Henke
1,450,674 A 4/1923 Marston
(Continued)

FOREIGN PATENT DOCUMENTS

CH 707068 4/2014
CN 1337349 2/2002
(Continued)

OTHER PUBLICATIONS

Supplementary Search Report and Written Opinion in EP18742361; dated Mar. 24, 2020.
(Continued)

*Primary Examiner* — John K Fristoe, Jr.
*Assistant Examiner* — Jennifer Castriotta
(74) *Attorney, Agent, or Firm* — Gerard J. McGowan, Jr.

(57) ABSTRACT

A cap. The cap comprises an outer cover, an inner cover, an inner container, and a base. The outer cover comprises an outer cover top and an outer cover body protruding from the outer cover top, and the outer cover top and the outer cover body form an inner cavity. The inner cover is set in the inner cavity of said outer cover, and a first female thread is set on the inner circumference of the inner cover body; a first male thread is set on the outer circumference of the inner container body, the first male thread matching the first female
(Continued)

thread. The base comprises a base top and a base body protruding from the base top, a second female thread is set on the inner circumference of the base body, and the base top is connected to the inner container bottom of the inner container.

12 Claims, 3 Drawing Sheets

(51) Int. Cl.

| | |
|---|---|
| ***B65D 51/18*** | (2006.01) |
| ***B65D 85/72*** | (2006.01) |
| ***A45D 40/24*** | (2006.01) |
| ***A45D 40/18*** | (2006.01) |
| ***A45D 40/00*** | (2006.01) |

(52) U.S. Cl.
CPC ..... *B65D 41/045* (2013.01); *B65D 51/18* (2013.01); *B65D 85/72* (2013.01); *A45D 2040/0006* (2013.01); *A45D 2200/25* (2013.01); *B65D 2251/0028* (2013.01); *B65D 2251/0093* (2013.01)

(58) Field of Classification Search
CPC .... A45D 2040/0006; A45D 2040/0012; A45D 2040/0018; A45D 40/0068; A45D 40/0081; A45D 2200/25; A45D 40/18
USPC ..... 220/521
See application file for complete search history.

(56) References Cited

U.S. PATENT DOCUMENTS

| | | | | |
|---|---|---|---|---|
| 2,076,550 | A | 4/1937 | Conner | |
| 2,077,215 | A | 4/1937 | Conner | |
| 2,077,216 | A | 4/1937 | Conner | |
| 2,077,218 | A | 4/1937 | Conner | |
| 2,114,872 | A | 4/1938 | Conner | |
| 2,328,872 | A | 9/1943 | Yealdhall | |
| 2,629,508 | A * | 2/1953 | Prager | B65D 51/28 206/221 |
| 2,766,796 | A * | 10/1956 | Tupper | A47G 23/03 220/521 |
| 2,836,323 | A | 5/1958 | Robinson | |
| 3,093,256 | A | 6/1963 | Woodbury | |
| 3,311,248 | A | 3/1967 | Marchant | |
| 3,332,429 | A | 7/1967 | Bates | |
| 3,347,423 | A | 10/1967 | Babbin | |
| 3,514,008 | A | 5/1970 | Dorn | |
| 3,620,399 | A | 11/1971 | Rapeaud | |
| 3,768,697 | A | 10/1973 | Lerner | |
| 3,871,543 | A | 3/1975 | Chadfield | |
| 4,165,815 | A * | 8/1979 | Vetter | B65D 21/0228 15/244.1 |
| 4,240,560 | A | 12/1980 | Carluccio | |
| 4,606,775 | A | 8/1986 | Robinson et al. | |
| 4,676,408 | A | 6/1987 | Speitel | |
| 4,693,366 | A | 9/1987 | Goncalves | |
| 4,757,916 | A | 7/1988 | Goncalves | |
| 5,078,287 | A | 1/1992 | Holmes | |
| 5,170,888 | A | 12/1992 | Goncalves | |
| 5,356,025 | A | 10/1994 | Renault | |
| 5,358,147 | A | 10/1994 | Adams | |
| 5,549,213 | A | 8/1996 | Robbins, III et al. | |
| 5,564,600 | A | 10/1996 | Renault | |
| 5,586,694 | A | 12/1996 | Breidenbach | |
| 5,707,698 | A | 1/1998 | Favre | |
| 5,765,708 | A | 6/1998 | Fragos | |
| 6,006,937 | A | 12/1999 | Baravaglio | |
| 6,068,396 | A | 5/2000 | Baudin | |
| 6,085,927 | A | 7/2000 | Kusz | |
| 6,145,685 | A | 11/2000 | Dick | |
| 6,352,168 | B1 | 3/2002 | Lin | |
| 6,427,863 | B1 | 8/2002 | Nichols | |
| 6,739,731 | B2 | 5/2004 | Katzman | |
| 6,910,573 | B2 | 6/2005 | Deans | |
| 6,923,347 | B2 | 8/2005 | Winckels | |
| 6,945,419 | B2 | 9/2005 | Bertazza | |
| 7,467,908 | B2 | 12/2008 | Francavilla | |
| 7,523,822 | B2 | 4/2009 | Sharon | |
| 7,735,665 | B2 | 6/2010 | Robinson | |
| D625,469 | S | 10/2010 | Dubitsky et al. | |
| D631,204 | S | 1/2011 | Dubitsky et al. | |
| D644,939 | S | 9/2011 | Teller | |
| 8,317,042 | B2 | 11/2012 | Cerveny | |
| 8,342,346 | B2 | 1/2013 | Rances | |
| 8,444,337 | B2 | 5/2013 | Teller | |
| 8,479,940 | B2 | 7/2013 | Marra | |
| 8,695,826 | B2 | 4/2014 | Furey | |
| 8,870,011 | B2 | 10/2014 | Hammer | |
| 8,888,391 | B2 | 11/2014 | Teller et al. | |
| 9,216,843 | B2 | 12/2015 | Sorensen | |
| 9,950,827 | B1 | 4/2018 | Lau | |
| 10,441,053 | B2 | 10/2019 | Hong et al. | |
| 2001/0027958 | A1 * | 10/2001 | Short | B65D 51/28 215/365 |
| 2005/0258126 | A1 | 11/2005 | Canamasas | |
| 2006/0043109 | A1 | 3/2006 | Masuda | |
| 2008/0011624 | A1 | 1/2008 | Robb et al. | |
| 2008/0035646 | A1 | 2/2008 | Smith | |
| 2008/0230540 | A1 | 9/2008 | Marra et al. | |
| 2009/0022541 | A1 | 1/2009 | De Laforcade | |
| 2010/0213085 | A1 | 8/2010 | Belnap | |
| 2011/0272410 | A1 | 10/2011 | Sato et al. | |
| 2011/0309083 | A1 | 12/2011 | Hsiu-Tzu | |
| 2012/0018337 | A1 | 1/2012 | Furey | |
| 2013/0075287 | A1 | 3/2013 | Sharon | |
| 2013/0098944 | A1 | 4/2013 | Broadney | |
| 2014/0131229 | A1 | 5/2014 | Tippit | |
| 2014/0251938 | A1 * | 9/2014 | Rose | B65D 51/28 215/6 |
| 2015/0076140 | A1 | 3/2015 | Roesler | |
| 2015/0076149 | A1 | 3/2015 | Roesler | |
| 2016/0159537 | A1 | 6/2016 | Pucci | |
| 2016/0251121 | A1 | 9/2016 | Hadar | |
| 2016/0311601 | A1 | 10/2016 | Genchev | |
| 2017/0215553 | A1 * | 8/2017 | Keller | A45D 40/16 |
| 2017/0217635 | A1 | 8/2017 | Johnson | |
| 2017/0275072 | A1 | 9/2017 | Siskron, III | |
| 2017/0318939 | A1 | 11/2017 | Kim | |
| 2018/0125198 | A1 * | 5/2018 | Burditt | A45D 40/0068 |
| 2018/0271255 | A1 | 9/2018 | Hong | |
| 2018/0333216 | A1 | 11/2018 | Whelan | |
| 2018/0334286 | A1 | 11/2018 | Yahalom | |
| 2019/0152649 | A1 | 5/2019 | Hadar | |
| 2019/0166975 | A1 | 6/2019 | Hong | |
| 2019/0313766 | A1 | 10/2019 | Perl | |

FOREIGN PATENT DOCUMENTS

| | | |
|---|---|---|
| CN | 1137256 | 2/2004 |
| CN | 101119904 | 2/2008 |
| CN | 101605699 | 12/2009 |
| CN | 102114934 | 7/2011 |
| CN | 203652368 | 6/2014 |
| CN | 104229289 | 12/2014 |
| CN | 204846772 | 12/2015 |
| CN | 105452122 | 3/2016 |
| CN | 105877114 | 8/2016 |
| CN | 106275811 | 1/2017 |
| CN | 206485775 | 9/2017 |
| DE | 9317521 | 1/1994 |
| DE | 10339807 | 4/2005 |
| DE | 102005006238 | 7/2006 |
| EP | 0661012 | 7/1995 |
| EP | 0970634 | 1/2003 |
| EP | 2623431 | 8/2013 |
| EP | 20150001855 | 5/2015 |
| EP | 3243405 | 11/2017 |
| FR | 1450924 | 6/1966 |
| FR | 2745276 | 8/1996 |

(56) References Cited

FOREIGN PATENT DOCUMENTS

| | | |
|---|---|---|
| FR | 2807739 | 10/2001 |
| GB | 1598682 | 9/1981 |
| GB | 2284254 | 5/1995 |
| JP | 6342537 | 3/1988 |
| JP | 6346331 | 3/1988 |
| JP | 565828 | 8/1993 |
| JP | 612324 | 2/1994 |
| JP | 613713 | 2/1994 |
| JP | 7017538 | 3/1995 |
| JP | 7277335 | 10/1995 |
| JP | 11268761 | 10/1999 |
| JP | J4564104 | 8/2010 |
| JP | 2011212368 | 10/2011 |
| JP | 2013103724 | 5/2013 |
| JP | 3185934 | 9/2013 |
| JP | 2015030459 | 2/2015 |
| JP | 2018104064 | 12/2016 |
| JP | 2018140833 | 2/2017 |
| JP | 2019081595 | 10/2017 |
| JP | 2017197283 | 11/2017 |
| KR | 20160097901 | 8/2016 |
| WO | WO2007022608 | 3/2007 |
| WO | WO2007110596 | 10/2007 |
| WO | WO2009092874 | 7/2009 |
| WO | WO2009123380 | 10/2009 |
| WO | WO2011129866 | 10/2011 |
| WO | WO2016091865 | 6/2016 |

OTHER PUBLICATIONS

Search Report and Written Opinion in PCTCN2018073215; dated Jan. 18, 2018.

Assignment from Cosmax to Unilever of Chinese utility model application No. 201720059034.7, issued as serial No. 201701200099287.

Search Report and Written Opinion in EP17175685; dated Dec. 6, 2017.

Search Report and Written Opinion in PCTEP2018059077; dated May 25, 2018.

IPRP in PCTEP2018059077; dated Mar. 19, 2019.

* cited by examiner

CONTAINER CAP AND A PACKAGE HAVING THE CAP

TECHNICAL FIELD

The present invention relates to the field of product packaging, and in particular relates to a cap and a package having the cap. The container cap is used to seal a container, wherein the cap further comprises an inner container and an inner cover and the inner container can contain cosmetics.

BACKGROUND

The cosmetics package in the current market comprises a container and a cap. The cap has a single function to simply seal contents, however. In addition, the cap has a very common appearance, but does not have any ingenious design or utility value.

Often consumer products intended for use on the skin or hair contain a perfume. While this arrangement is suitable for many consumers, it can be expected that some consumers will want to apply perfume separately; or to different parts of the body than the areas on which the skin or hair product will be used.

Various arrangements for dispensing perfume and other personal products are provided in the patent literature.

Berlanger FR 1450924 (Parfums Caron) discloses a cap for a tube containing Cream or any other hygiene product or of perfumery. The cap can serve as a bucket and comprises two parts: a body having two opposed cavities and a head which can be screwed onto the body. The body can be screwed onto the neck of a tube.

WO 2009/123380 is directed to a cap for a cosmetic container, wherein a puff is integrally coupled to the cap.

DeLaforcade US 2009/0022541 discloses a packaging and applicator device for applying at least one cosmetic item.

Bates U.S. Pat. No. 3,332,429 discloses an applicator and receptacle adapted to freeze liquid cosmetics into a form where it is rigidly associated with the applicator, which also acts as the cover for the container.

Mallochet WO 2009/092874 (Chanel Parfums Beaute) discloses a device for storing and releasing a fragrance. The device includes a presenting rod in a confining closure comprising a collar. The presenting rod includes a porous portion loaded with fragrance and a head suitable for grasping.

Teller et al. U.S. Pat. No. 8,888,391 discloses a substantially spherical lip balm applicator product. Lip balm products are also disclosed in Teller U.S. Pat. No. D644,939, Teller U.S. Pat. No. 8,444,337, Dubitsky U.S. Pat. No. D625,469 and Dubitsky et. al. U.S. Pat. No. D631,204.

Houyoux WO 2016/091865 (Reload Labs) is directed to a perfume tester.

SUMMARY OF THE INVENTION

The technical problem to be solved by the present invention is to provide a cap and a package having the cap to overcome the defects such as single function and common appearance of the cap of the container in the prior product packages. With contents hidden in the cap, the cap is given to customers as a gift. In this way, the cap can not only realize the sealing function, but also give a surprise to the customer. The present invention is small and exquisite in appearance, fashionable, and very convenient to carry.

The present invention solves the above-mentioned technical problem by adopting the following technical solutions:

One technical solution of the present invention is: A cap comprises an outer cover, an inner cover, an inner container, and a base, where said outer cover comprises an outer cover top and an outer cover body protruding from the outer cover top, and said outer cover top and said outer cover body form an inner cavity;

said inner cover comprises an inner cover top and an inner cover body protruding from the inner cover top, a first female thread is set on the inner circumference of said inner cover body, and said inner cover is set in said inner cavity of said outer cover;

said inner container comprises an inner container bottom and an inner container body protruding from the inner container bottom, a first male thread is set on the outer circumference of said inner container body, and said first female thread matches said first male thread;

said base comprises a base top and a base body protruding from the base top, a second female thread is set on the inner circumference of said base body and said base top is connected to the inner container bottom of the inner container.

Preferably, said cap of the present invention further comprises the content contained in said inner container.

Said content is a common content, preferably, a cosmetic, and more preferably, a balm or a solid perfume.

Preferably, said container in said cap of the present invention further comprises a washer or parafilm.

Said washer or parafilm can prevent a content from overflowing.

Preferably, said outer cover and said inner cover are connected together through a fastener.

Preferably, said base top and the inner container base of the inner container are connected together through a clamp.

Preferably, said cap is connected to the container opening of said container through a connection sleeve. Said connection is the connection between said second female thread and said second male thread.

In said cap, said outer cover, inner cover, inner container, and base are common, and preferably are plastic outer cover, plastic inner cover, and plastic base.

Another technical solution of the present invention is: A package having the above-mentioned cap, comprises said cap and container, wherein a container opening, is set on the top of said container, the second male thread is set on the outer circumference of the container opening, and said second male thread matches said second female thread in said cap.

Preferably, in the package having the above-mentioned cap in the present invention, said container further comprises a washer or parafilm. Said washer or parafilm can prevent a content from overflowing.

In said package having the above-mentioned cap, said container is a conventional container, preferably a plastic container or glass container.

Positive and progressive effects of the present invention: The present invention is small and exquisite in appearance and is fashionable. While satisfying the functions of a cap, the present invention is also a container. The present invention can not only serve as a cap of some cosmetic containers, but also as a container of some cosmetics. Small designs are made for the cap and small things are put into the cap as thanksgivings so that the present invention can bring a surprise to the customer when the customer uses it. The present invention is small and exquisite in appearance, fashionable, and convenient to carry.

The exemplified structure minimizes premature exposure of the perfume to the atmosphere, and thereby minimizes loss of perfume.

BRIEF DESCRIPTION OF THE DRAWINGS

The following further describes the present invention by reference to the drawings.

DETAILED DESCRIPTION OF THE INVENTION

The following gives a preferred embodiment to more clearly and completely describe the present invention in combination with the drawings.

Figure 1:
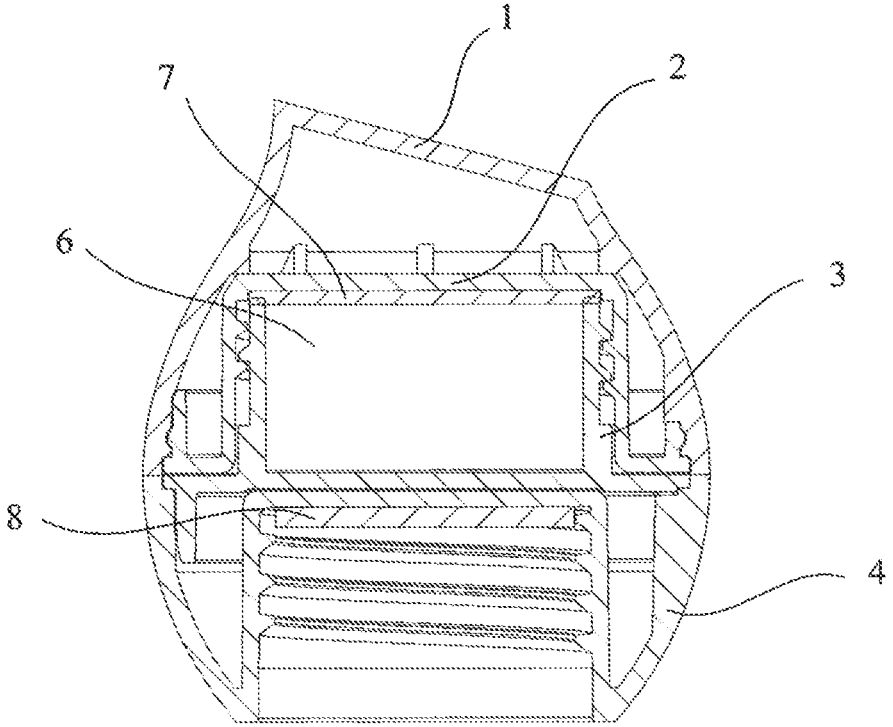
FIG. 1 shows the structure of the cap of the present invention in the closed state.
Figure 2:
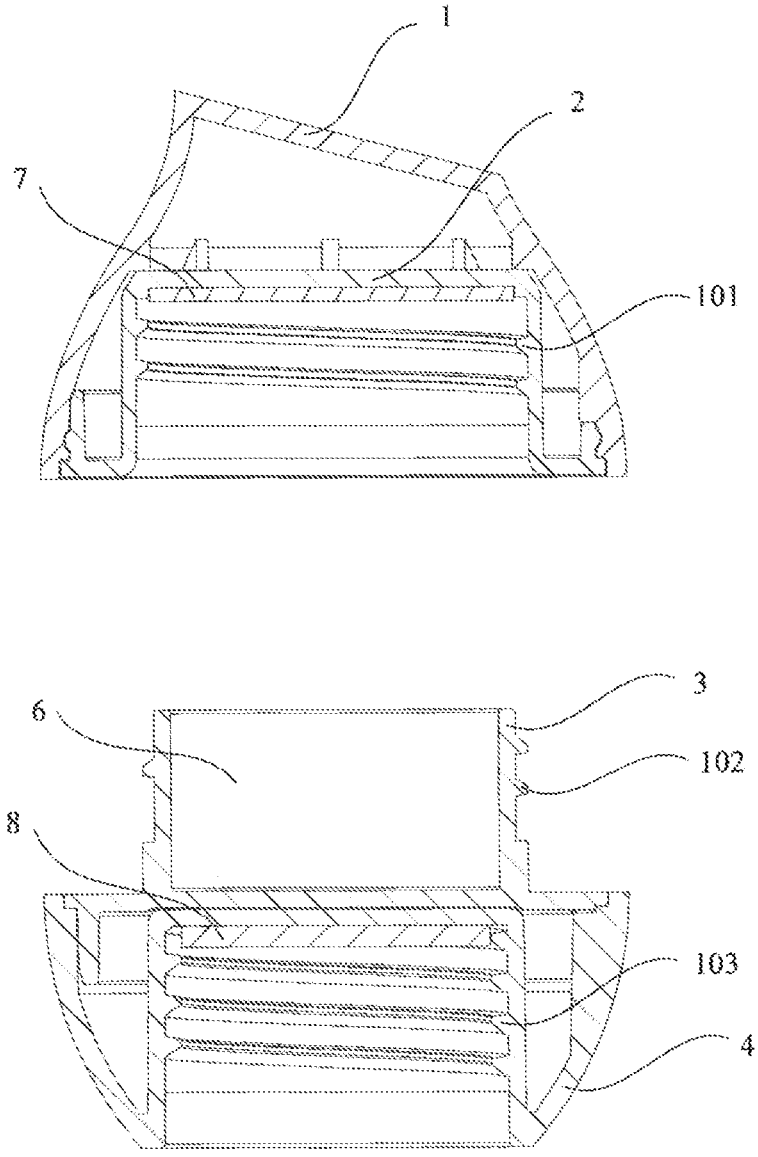
FIG. 2 shows the structure of the cap of the present invention in the opened state.

As shown in FIG. 1 and FIG. 2, the cap of the present invention comprises an outer cover (1), an inner cover (2), a container (3), and a base (4).

Among them, said outer cover (1) is opened downward and comprises an outer cover top and an outer cover body protruding from the outer cover top. Said outer cover top and said outer cover body form an inner cavity.

Said inner cover (2) is opened downward and comprises an inner cover top and an inner cover body protruding from the inner cover top. A first female thread (101) is set on the inner circumference of said inner cover body. Said inner cover (2) is set in the inner cavity of said outer cover (1). Said outer cover (1) and said inner cover (2) are connected together through a fastener.

Said inner container (3) is opened upward and comprises an inner container bottom and an inner container body protruding from the inner container bottom. A first male thread (102) is set on the outer circumference of said inner container body. Said first female thread (101) matches the first male thread (102).

In an embodiment, the inner cover opens downward and comprises an inner cover top and an inner cover body protruding from the inner cover top, the inner cover top covering the inner cover body which protrudes from the inner cover top, a first female thread is set on an inner circumference of the inner cover body, and the downward opened inner cover body is set in the inner cavity of said outer cover.

Said base (4) is opened downward and comprises a base top and a base body protruding from the base top. A second female thread (103) is set on the inner circumference of said base body. Said base top is connected to the inner container bottom of the inner container (3). Said base top and the inner container base of the inner container (3) are connected together through a clamp.

The cap of the present invention further comprises a content (6) and said content (6) is contained in said inner container (3).

Said content (6) is a balm or solid perfume.

In said cap, said outer cover (1), inner cover (2), inner container (3), and base (4) are all made of plastic.

Said inner container (3) further comprises a washer or parafilm (7). Said washer or parafilm (7) can prevent the content (6) from overflowing.

Figure 3:
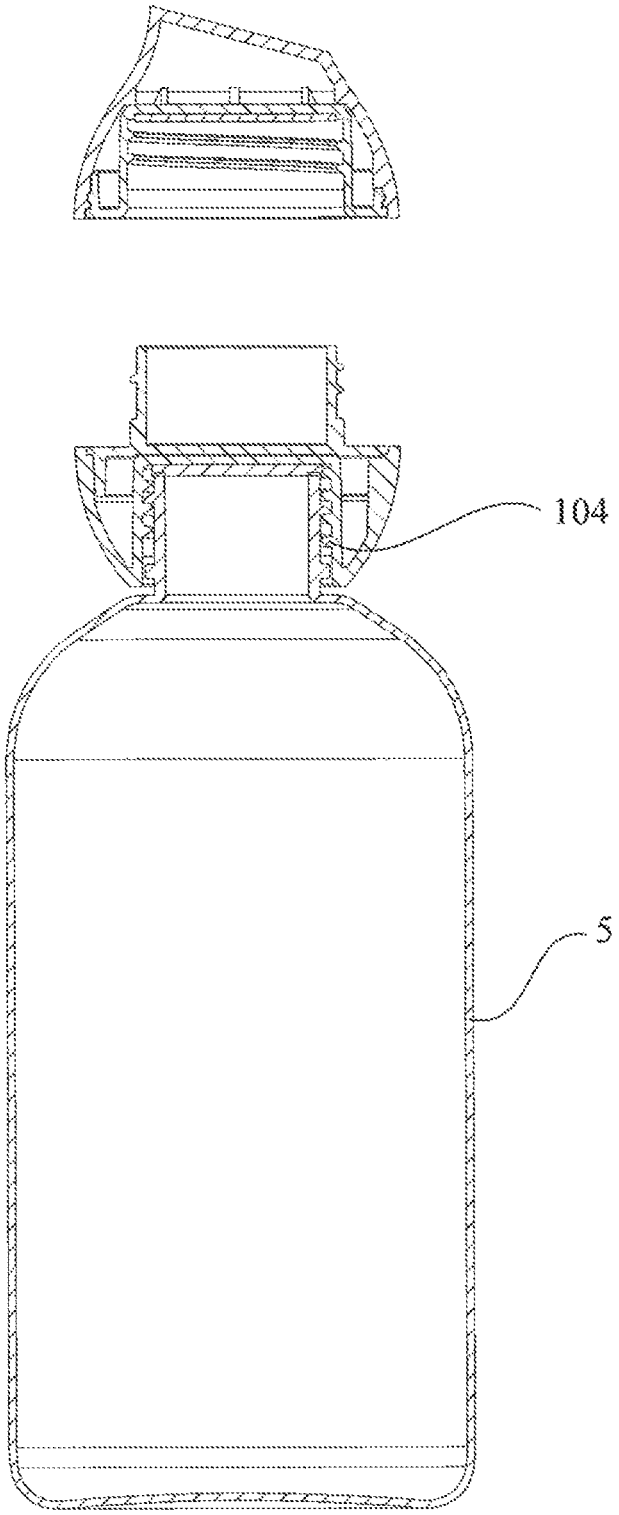
FIG. 3 shows the way the cap of the present invention is screwed onto a container.

As shown in FIG. 3, the package having the above-mentioned cap in the present invention comprises the above-mentioned cap and a container (5). A container opening is set on the top of said container (5), and a second male thread (104) is set on the outer circumference of the container opening. Said second female thread (103) matches said second male thread (104).

Said cap is connected to the container opening of said container (5) through a connection sleeve. Said connection is the connection between said second female thread (103) and said second male thread (104).

In the package having the above-mentioned cap in the present invention, said container (5) further comprises a washer or parafilm (8). Said washer or parafilm (8) can prevent the content (6) from overflowing.

In the package having the above-mentioned cap, said container (5) is made of plastic or glass.

The cap of the present invention is also a container. FIG. 1 shows the closed state of the cap. FIG. 2 shows the opened state of the cap. FIG. 3 shows the way the cap of the present invention is screwed onto the container (5).

In the description of the present invention, it should be understood that the direction or position relationships indicated by the terms "upward", "downward", "front", "back", "left", "right", "vertical", "horizontal", "top", "bottom", "in", "inner", and "outer" are all based on the direction or position relationships shown in the drawings, and are only used to describe the present invention and simplify the description, but not used to indicate or imply that the designated device or element must have a specific direction or must be constructed and operated in a specific direction. Therefore, it should not be understood that these terms are used to restrict the present invention.

In the description of the present invention, it should be pointed out that unless otherwise expressly specified and defined, the terms "installation", "interconnection", and "connection" should be understood in a broad senses. For example, they can refer to a fixed connection, a detachable connection, or an integrated connection; a direct connection or an indirect connection through an intermediate; an internal connection between two elements or interaction relationship between two elements. Those skilled in the art can understand the specific meanings of the above-mentioned terms in the present invention according to the specific conditions.

The constructions and operations of the cap and the package having the cap in the present invention are common to those skilled in the art, and will not be described here again. The present invention is small and exquisite in appearance and is fashionable. While satisfying the functions of a cap, the present invention is also a container. The present invention can not only serve as a cap of some cosmetic containers, but also as a container of some cosmetics. Small designs are made for the cap and small things are put into the cap as thanksgivings so that the present invention can bring a surprise to the customer when the customer uses it.

Solid perfumes are known in the art.

Solid perfumes are available from Pacifica and other companies.

The arrangement of the closure permits the consumer to access the separate consumable without accessing the consumable within the package. That is, the consumer need not open the package.

By "removably" herein it is mean that the indicated structure can be removed with application of modest force by a human being, such as the force needed to unscrew a cap from a bottle intended to be opened by a human.

Those skilled in the art should understand that the above-mentioned embodiment of the present invention is given only for the illustration purpose and the protection scope of the present invention is defined by the claims attached. Those skilled in the art can make various variations and modifications without departing from the principle and essence of the present invention, but these variations and modifications shall all fall within the protection scope of the present invention.

The invention claimed is:

1. A cap, comprising an outer cover, an inner cover, an inner container, and a base, characterized in that said outer cover comprises an outer cover top and an outer cover body protruding from the outer cover top, and said outer cover top and said outer cover body form an inner cavity;

said inner cover opened downward and comprises an inner cover top and an inner cover body protruding from the inner cover top, the inner cover top covering the inner cover body, a first female thread is set on an inner circumference of said inner cover body, and said downward opened inner cover body is set in said inner cavity of said outer cover;

said inner container opened upward and comprises an inner container bottom and an inner container body protruding from the inner container bottom, a first male thread is set on an outer circumference of said inner container body, and said first male thread matches said first female thread;

said base opening downward and comprising a base top and a base body protruding from the base top, a second female thread is set on an inner circumference of said base body, and said base top is connected to the inner container bottom of the inner container.

2. The cap according to claim 1, characterized in that said cap further comprises solid perfume contained in said inner container.

3. The cap according to claim 1, characterized in that said inner container further comprises a washer or parafilm.

4. The cap according to claim 1, characterized in that said outer cover and said inner cover are connected together through a fastener.

5. A package comprising the cap including the inner container as claimed in claim 1, further including a second container having a second container opening being set on the top of said second container, a second male thread being set on an outer circumference of said second container opening, said second male thread matching said second female thread in the cap.

6. The package according to claim 5, characterized in that said second container further comprises a washer or parafilm.

7. The cap according to claim 1 in combination with solid perfume wherein the cap comprises said solid perfume and further wherein the base is used for connecting the cap to a second container having a container opening.

8. The cap according to claim 7 wherein the inner container is removable from the base.

9. The cap according to claim 1 in combination with perfume, the inner container containing the perfume which at room temperature retains its shape rather than assuming the shape of its container.

10. The cap according to claim 9 in combination with a bottle comprising a second, different consumable product.

11. The combined cap and bottle of claim 10 wherein the second consumable product is a body wash.

12. The combined cap and bottle according to claim 10 wherein removal of the cap base from the bottle when the outer cover is connected to the cap base does not expose the perfume to the exterior of the cap.

* * * * *